US008066099B2

(12) United States Patent
Liang

(10) Patent No.: US 8,066,099 B2
(45) Date of Patent: Nov. 29, 2011

(54) RETRACTABLE LADDER

(76) Inventor: Yaoguang Liang, Guangdong (CN)

( * ) Notice: Subject to any disclaimer, the term of this patent is extended or adjusted under 35 U.S.C. 154(b) by 296 days.

(21) Appl. No.: 12/552,763

(22) Filed: Sep. 2, 2009

(65) Prior Publication Data

US 2011/0005864 A1 Jan. 13, 2011

(30) Foreign Application Priority Data

Jul. 9, 2009 (CN) ..... 2009 2 0060135 U

(51) Int. Cl.
*E06C 7/00* (2006.01)

(52) U.S. Cl. ..... 182/195; 182/209

(58) Field of Classification Search ..... 182/195, 182/209

See application file for complete search history.

(56) References Cited

U.S. PATENT DOCUMENTS

| | | | | |
|---|---|---|---|---|
| 2,975,857 | A * | 3/1961 | Suroff et al. | 182/166 |
| 4,989,692 | A * | 2/1991 | Min | 182/166 |
| 5,062,499 | A * | 11/1991 | Tu | 182/166 |
| 7,316,293 | B2 * | 1/2008 | Yao et al. | 182/195 |
| 7,967,110 | B2 * | 6/2011 | Parker | 182/77 |
| 2009/0065304 | A1 * | 3/2009 | Jian | 182/209 |

FOREIGN PATENT DOCUMENTS

CN 201141279 Y 11/2007

OTHER PUBLICATIONS

Official Search Report and Written Opinion of the European Patent Office in counterpart foreign Application No. 09169249.1-1255.

* cited by examiner

*Primary Examiner* — Alvin Chin Shue
(74) *Attorney, Agent, or Firm* — Kinney & Lange, P.A.

(57) ABSTRACT

The present invention discloses a retractable ladder which is a common climbing tool in daily life and engineering industry. The retractable ladder comprises a pedal operated unlock device, section-positioning lock devices and an accidental operation preventing device. The main components of the unlock device is disposed in the first ladder section and enclosure caps at upper ends of each ladder section, except for the uppermost ladder section, are provided with the lock devices and unlock nose spikes. The retractable ladder is changed from an extended state to a folded state simply by operating the unlock device with foot of the user so as to release the lock of the ladder. Consequently, the retractable ladder will automatically retract to descend all of the ladder sections from top to bottom in turn. When the ladder is changed from the folded state to the extended state, section-positioning pins are pulled out downwardly from the uppermost ladder section so as to lock the ladder sections. The retractable ladder of the present invention is configured to extend and retract conveniently, and the use of the ladder is very easy. Further, the retractable ladder is advantageous in ease of assembling and maintenance, Meanwhile, safety is ensured so as to prevent hurts of hands of the user which may occur when a manual retractable ladder is used. In addition, the retractable ladder has advantages of low cost, safe operation and prominent improvements to the art.

11 Claims, 2 Drawing Sheets

RETRACTABLE LADDER

CROSS-REFERENCE TO RELATED APPLICATION

This application claims the benefit of Chinese Utility Model Patent Application No. 200920060135.1 filed on Jul. 9, 2009 in the State Intellectual Property Office of China, the disclosure of which is incorporated herein by reference.

FIELD OF INVENTION

The present invention relates to a climbing tool, more particularly, to a retractable ladder for climbing to a higher position in daily life and engineering industry.

BACKGROUND OF INVENTION

Ladders are essential articles in daily life and engineering industry. Some of ladders have long length so that it is inconvenient for carrying and storing them. In view of this, a conventional retractable ladder has been developed in the prior art. In general, this retractable ladder extends to its greater length at deployed position in use and retracts to its shorter length at its retracted or stowed position so as to be easily and conveniently carried and stored and thus become popular.

In one embodiment of the prior art, such a retractable ladder is provided with a pedal actuated device for descending the ladder sections. The pedal actuated device is disposed at the lowest rung member on a connecting rod which is movable at inside of the ladder stile of the rung member. The connecting rod is connected with a transmission means, which is disposed in a box of the lowest rung member of the ladder rung member, via a steel wire. The trailing end of the transmission means has an approximately U-shape transmission piece of which one end is shaped to move along with the connecting rod. The device for descending ladder sections comprises a foot pedal, a pulling rod and ropes. The rung box comprises a box, a manipulating hook, a guide bracket, a catch plate, a connecting rod, a transmission pin, a pin base, a transmission piece and the like.

It is apparent from the above that the device has a complicated structure, thereby resulting in a high cost and difficulty in assembling and maintenance.

SUMMARY OF INVENTION

The present invention has been made to overcome or alleviate at least one aspect of the above mentioned disadvantages.

Accordingly, it is an object of the present invention is to provide a retractable ladder that can easily extend to its deployed position and retract to its stowed position, and has a simple configuration. Moreover, this retractable ladder is easy to be assembled and maintained, thus the overall cost of the ladder is relatively low. Furthermore, it is safe, and provides great convenience and comfort for users in daily life and engineering industry.

According to the present invention, the retractable ladder comprises a plurality of ladder sections from top to bottom in which each ladder section comprises a rung member and stile disposed at both sides of the rung member, wherein the two adjacent ladder sections are slidable relative to each other to achieve extension and retraction of the plurality of ladder sections, characterized in that, the retractable ladder comprises: a plurality of section-positioning lock devices disposed at upper ends of the stile at both sides of each ladder section except for the uppermost ladder section, each of the section-positioning lock devices comprising a pin rod, a circular through hole and a first reset spring, wherein the pin rod is laterally disposed in the section-positioning lock device and can move horizontally, the circular through hole is formed on the pillar of the respective ladder sections to correspond to the pin rod so as to insert the pin rod to lock the ladder sections, and the first reset spring is connected with the pin rod and applies a biasing force on the pin rod so as to the pin rod is inserted into the circular through hole to lock respective stile; and a pedal operated unlock device for releasing the lock of the ladder to retract the ladder to a folded or stowed state for storage, the pedal operated unlock device comprising a pedal rotational shaft, a unlock pedal, a unlock jogger, a nose spike and a lateral pin, wherein the pedal rotational shaft is fixed at its two ends to eccentric wheels disposed in inner cavities of the stile at both sides of the lowest ladder section, respectively, the unlock pedal is fitted over the pedal rotational shaft and is capable of moving side to side along the pedal rotational shaft, the unlock jogger is disposed on the eccentric wheel and movable up and down along the inner cavity of the stile, the nose spike is disposed at an upper end of the unlock jogger and an upper portion of respective enclosure cap of the stile at both sides of each ladder section except for the uppermost ladder section, and the lateral pin is disposed in the middle of the pin rod and radially perpendicular to the pin rod, wherein, a user operates to rotate the unlock pedal and the pedal rotational shaft so that the nose spike moves upwardly and acts on the lateral pin to cause the pin rod to return backwards, thereby releasing lock of respective ladder sections by means of the section-positioning lock devices so as to retract the ladder to the folded state.

The section-positioning lock device is formed as a box which is disposed laterally and one side thereof, which is opposite to the pillar of the respective ladder sections, is formed as an open end and the other side is formed as a close end.

The first reset spring is disposed between a trailing end of the pin rod and a closed sidewall of the box.

The nose spike is formed to have a shape of forked post with a bevel surface.

The extending position of the lateral pin corresponds to the nose spike when the pin rod is inserted into the circular through hole under biasing action of the first reset spring.

The retractable ladder further comprises: an accidental operation preventing pin disposed at one end of the unlock pedal near the stile; a pin hole which is formed on the lowest stile of the retractable ladder and is located at a position corresponding to the accidental operation preventing pin; and a second reset spring fixed between the unlock pedal and the pedal rotational shaft to apply a biasing force on the unlock pedal, wherein the accidental operation preventing pin is inserted into the pin hole under action of the second reset spring so that the unlock pedal cannot rotate so as to prevent accidental operation of the pedal operated unlock device.

The pedal operated unlock device is provided with a third reset spring which is fixed between the unlock jogger and the inner cavity of the stile to apply a biasing force on the unlock jogger.

The retractable ladder further comprises a binding tape disposed on at least one ladder sections and the biding tape is used to bind the ladder sections so as to maintain the folded state when the ladder has been brought into the retracted state.

The stiles of each ladder section overlap on the stile of the adjacent ladder section with each other to ensure strength of the ladder in its extended state.

The adjacent stiles have an overlapping length of about 50-250 mm therebetween.

The unlock pedal is disposed at the lowest ladder sections at a height of about 10-20 cm above ground.

The retractable ladder according to at least one unspecific embodiments of the present invention has advantages that the ladder can easily extend to its deployed position and retract to its stowed position, and has a simple configuration. In the meantime, this retractable ladder is easy to be assembled and maintained, thus the overall cost of the ladder is relatively low. Furthermore, it is safe, and provides great convenience and comfort for users in daily life and engineering industry.

DETAILED DESCRIPTION OF PREFERRED EMBODIMENTS OF THE INVENTION

Figure 1:
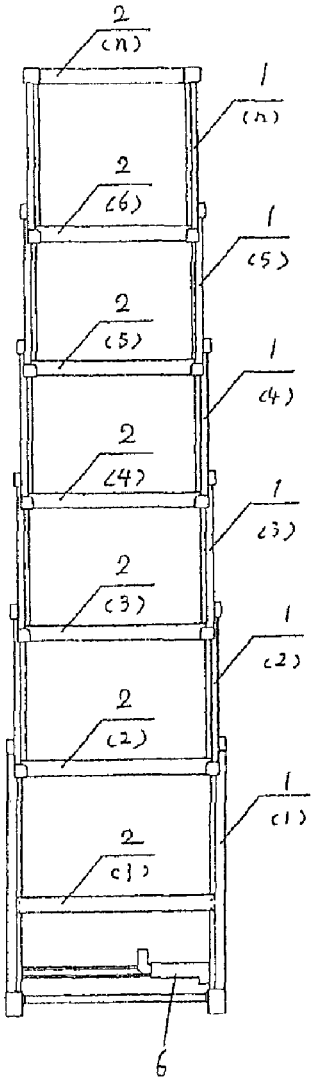
FIG. 1 is a schematic view illustrating the retractable ladder according to the present invention in its extended position in use.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

A retractable ladder according to the present invention comprises a plurality of ladder sections (1), (2) . . . (n) from bottom to top, as shown in FIG. 1. Here, FIG. 1 illustrates seven ladder sections. However, the present invention is not limited to this number whereas n can be any appropriate positive integer. Further referring to FIG. 1, each ladder section has a rung member 2 and a pair of stiles 1,1 disposed at both sides of the rung member 2. In one embodiment, the stile 1 is configured to be in a form of ladder pillar and the two adjacent ladder sections are slidable relative to each other to achieve extension and retraction of the plurality of ladder sections.

Figure 2:
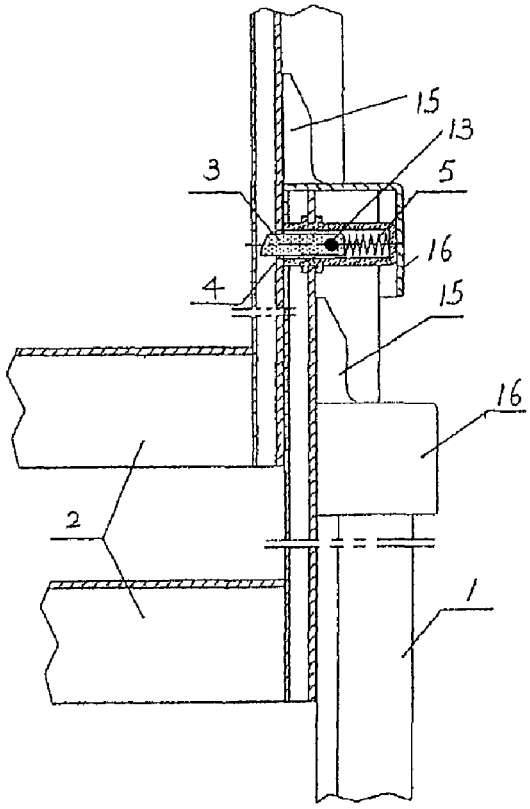
FIG. 2 is a schematic view illustrating configuration and position of the section-positioning lock device of the retractable ladder according to the present invention in its extended position in use.
Figure 3:
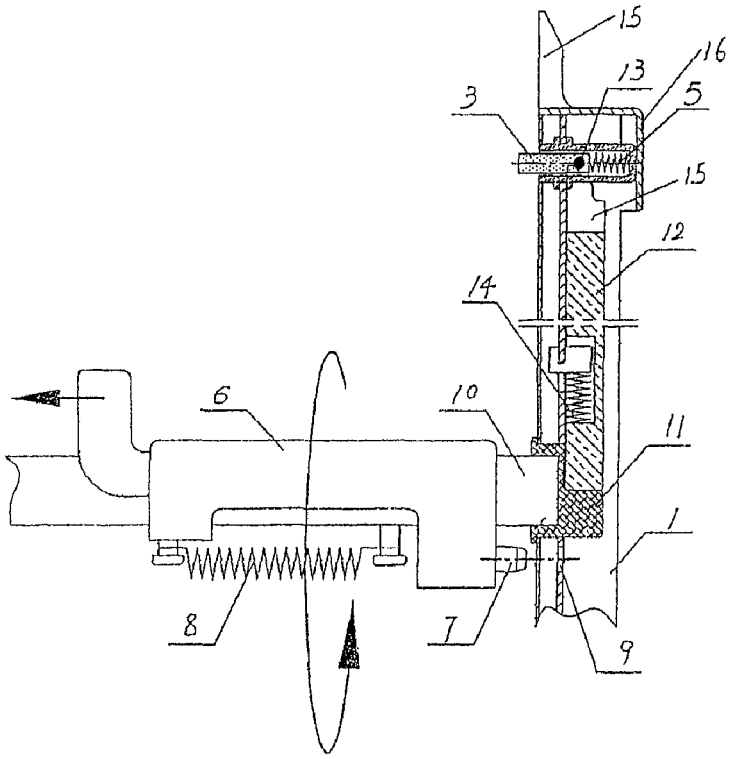
FIG. 3 is a schematic view illustrating configuration and position of the pedal operated unlock device and operation of changing the ladder according to the present invention from an extended state to a folded state.

With reference to FIGS. 2 and 3, the retractable ladder according to the present invention is also provided with a pedal operated unlock device in addition to the respective ladder sections. The unlock device comprises a unlock pedal 6 which is provided with an accidental operation preventing pin 7 at one end thereof near the ladder stile. The unlock pedal 6 is capable of moving side to side along a pedal rotational shaft 10 and is fitted over outside of the pedal rotational shaft 10. Both ends of the pedal rotational shaft 10 are fixed to eccentric wheels 11 which are disposed in inner cavities of the stiles 1,1 at the both sides of the first (lowest) ladder section (1) of the retractable ladder. A unlock jogger 12 is disposed above the eccentric wheel and is movable up and down along the inner cavity of the ladder stile. The upper end of the unlock jogger 12 is formed to be a nose spike 15 with a forked post with a bevel surface. A pin hole 9 is disposed at a position on the stile 1 which corresponds to the accidental operation preventing pin 7 of the unlock pedal 6.

Section-positioning lock devices are disposed at the ladder stiles except for those of the uppermost section, and respectively located at portions of the upper ends of the stiles 1,1 overlapping with the adjacent stiles, as shown in FIGS. 2 and 3. The section-positioning lock device is formed as a box which is disposed laterally and a side surface of one end thereof, which is directed toward inside, is open. The box is laterally provided with a pin rod 3 therein, and a small lateral pin 13 is disposed in the middle of the pin rod 3 and is radially perpendicular to the pin rod 3. A reset spring 5 is disposed between the trailing end of the pin rod 3 and one sidewall of the box. The lateral pin 13 extends from the outer wall of the box through a pin orifice 4 formed in the inner side of the ladder sections, and the extending position of the lateral pin 13 corresponds to the nose spike 15 at the upper end of the unlock jogger 12 or an enclosure cap 16.

Further, as to the remaining ladder sections except for the uppermost section of the retractable ladder, each of sections is provided with the above nose spike 15 with the upwardly forked post with a bevel surface at the upper portions of the enclosure caps 16 of the stile 1,1 thereof. The unlock joggers 12 are only disposed in the inner cavities of the stiles at both sides of the first ladder section 1. The stiles 1,1 of each section, except for the stiles of the first (lowest) section, are formed with circular through holes 4 at a position to insert the pin rods 3 for positioning the ladder sections so as to lock the sections.

A reset spring 8 is fixed at a position between the unlock pedal 6 and the pedal rotational shaft 10. A reset spring 14 is fixed at a position between the unlock jogger 12 and the inner cavity of the pillar 1.

Figure 4:
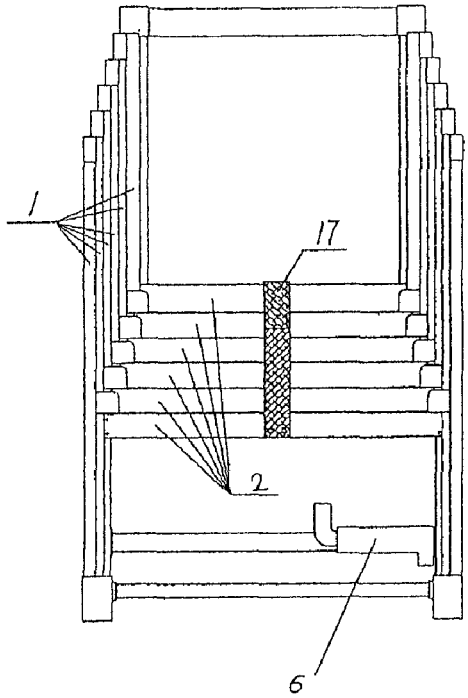
FIG. 4 is a schematic view illustrating entire ladder according to the present invention after being folded.

As shown in FIG. 4, the rung members 2 of the retractable ladder according to the present invention are bound with a binding tape 17 after the retractable ladder is folded.

The operating principle of the retractable ladder according to the present invention is described as follows:

1. FIG. 1 illustrates the operating state when the ladder extends to its deployed position. The ladder consists of ladder sections and each section comprises the stiles 1,1 and the rung member 2. Each stile 1 and its associated or adjacent stile have a superposing or overlapping length of 50 mm~250 mm therebetween to ensure bending strength of the ladder. In the drawings, the numbers included in brackets indicate the ladder sections.

2. FIG. 2 illustrates the section lock device for locking the ladder at the extended state. The lock device is mounted at the upper end of the stile 1. The lock device comprises the pin rod 3 which is movable horizontally and has a circular shape in its section; the circular hole 4 formed on the stile 1; and a spring 5 which is connected with the pin rod 3 and applies a biasing force on the pin rod 3. One end of this pin rod 3 is formed to be an inclined face or spherical face. As the ladder deploys, the pin rod 3 is automatically inserted into the circular hole 4 on the stile 1 under action of the spring 5 when the pin rod 3 is aligned with the circular hole 4. Accordingly, the stile 1 cannot be pulled out and the ladder will not descend downwardly, thus the ladder maintains its extended state until all of the ladder sections extend to their deployed position.

3. FIG. 3 illustrates the unlock device of the ladder according to the present invention. The lower portion of the ladder is provided with the rotatable unlock pedal 6 at a height (i.e., an appropriate height reached by foot of a user when the user raises his foot) of about 10 cm~20 cm above the ground. The pedal is provided with the accidental operation preventing pin 7. The accidental operation preventing pin 7 is inserted into the hole 9 formed in the lowest stile 1 under biasing action of the spring 8 so that the unlock pedal 6 cannot rotate so as to prevent mis-operation by other person to jeopardize safety of the user. When the ladder is to be folded to a portable stowed state from the extended state, the user draws the unlock pedal 6 with the foot at the same side as the unlock pedal 6 toward the other side so that the accidental operation preventing pin 7 is pulled out of the hole 9 formed in the stile 1. Then, the unlock pedal 6 is rotated while the eccentric wheel 11 operates along with movement of the rotational shaft 10 of the unlock pedal 6 to move the unlock joggers 12 upwardly. The upper end of the unlock jogger 12 has the nose spike 15 with a forked post with a bevel surface. The nose spike 15 with a forked post with a bevel surface moves upwardly and acts on the lateral pin 13 of the pin rod 3 so that the pin rod 3 returns backwards to achieve unlock operation for the section-positioning lock device. Finally, the stiles 1 above the lowest stile retract and slip down in turn along with rung members 2 as shown in FIG. 4. In the above unlocking process, the unlock pedal 6 is automatically reset under action of the spring 8 when the unlock pedal 6 is released by the user after rotating the unlock pedal 6. As such, after the section-positioning lock device is unlocked by returning the pin rod 3 backwards due to the action of the nose spike 15 on the lateral pin 13 of the pin rod 3, the eccentric wheel 11 linked with the rotational shaft 10 of the unlock pedal 6 restores to its initial state so that the unlock jogger 12 and the nose spike 15 formed at the upper end thereof thus restore to their initial state and slip down along with respective ladder sections.

4. FIG. 4 illustrates the portable storage state of the ladder after being folded. For holding the ladder at the folded state upon carrying the ladder, the ladder sections are bound with a binding tape 17, as shown in FIG. 4, so that the ladder cannot deploy due to own weight while the ladder is carried by users, thereby facilitating carrying operation of the ladder.

Although the retractable ladder according to the present invention has been described with reference to the above preferable embodiments, the present invention is not limited thereto. Those skilled in the art will appreciate that various change, replacement and modification may be made to the embodiment without departing from the principle and spirit of present invention, and the scope of the present invention is limited solely by the appended claims and its equivalents.

The invention claimed is:

1. A retractable ladder, comprising a plurality of ladder sections from top to bottom in which each ladder section comprises a rung member and stiles disposed at both sides of the rung member, wherein the two adjacent ladder sections are slidable relative to each other to achieve extension and retraction of the plurality of ladder sections, characterized in that, the retractable ladder comprising:

a plurality of section-positioning lock devices disposed at upper ends of the stiles at both sides of each ladder section except for the uppermost ladder section, each of the section-positioning lock devices comprising:

a pin rod laterally disposed in the section-positioning lock device and being movable horizontally, a circular through hole formed on stiles of the respective ladder sections to correspond to the pin rod so that the pin rod can be inserted therethrough to lock the ladder sections, and a first reset spring connected with the pin rod, and the first reset spring applying a biasing force on the pin rod so that the pin rod is inserted into the circular through hole to lock an adjacent stile; and a pedal operated unlock device for releasing the locking of the ladder sections to retract the ladder to a folded state for storage, the pedal operated unlock device comprising:

a pedal rotational shaft which is fixed at its two ends to eccentric wheels disposed in inner cavities of the stiles at both sides of the lowest ladder section, an unlock pedal which is fitted over the pedal rotational shaft and is capable of moving side to side along the pedal rotational shaft, an unlock jogger disposed on the eccentric wheel and being movable up and down along the inner cavity of the stile, a nose spike disposed at an upper end of the unlock jogger and an upper portion of enclosure caps of the stiles at both sides of each ladder section except for the uppermost ladder section, and a lateral pin disposed in the middle of the pin rod and being radially perpendicular to the pin rod, wherein a user operates to rotate the unlock pedal and the pedal rotational shaft so that the nose spike moves upwardly and acts on the lateral pin to cause the pin rod to retract, thereby releasing the locking of respective ladder sections with the section-positioning lock devices so as to retract the ladder to the folded state.

2. The retractable ladder according to claim 1, wherein the section-positioning lock device is formed as a box which is disposed laterally with a first side opposite to the stiles of the respective ladder sections, having an open end and a second opposite side having a close end.

3. The retractable ladder according to claim 2, wherein the first reset spring is disposed between a trailing end of the pin rod and a closed sidewall of the box.

4. The retractable ladder according to claim 1, wherein the nose spike is formed to have a shape of forked post with a bevel surface.

5. The retractable ladder according to claim 4, wherein the position of the lateral pin corresponds to the nose spike when the pin rod is inserted into the circular through hole under biasing action of the first reset spring.

6. The retractable ladder according to claim 3, further comprising:

an accidental operation preventing pin disposed at one end of the unlock pedal near the stile;

a pin hole which is formed on the lowest stile of the retractable ladder and is located at a position corresponding to the accidental operation preventing pin; and a second reset spring fixed between the unlock pedal and the pedal rotational shaft to apply a biasing force on the unlock pedal, wherein the accidental operation preventing pin is inserted into the pin hole under action of the second reset spring so that the unlock pedal cannot rotate to prevent accidental operation of the ladder.

7. The retractable ladder according to claim 1, wherein the pedal operated unlock device is provided with a third reset spring which is fixed between the unlock jogger and the inner cavity of the stile to apply a biasing force on the unlock jogger.

8. The retractable ladder according to claim 1, further comprising a binding tape disposed on at least one ladder sections, the biding tape being used to bind the ladder sections at the folded state when the ladder has been brought into the retracted state.

9. The retractable ladder according to claim 1, wherein the stiles of each ladder section overlap on the stiles of the adjacent ladder section to ensure strength of the ladder.

10. The retractable ladder according to claim 9, wherein the adjacent stiles have an overlapping length of about 50-250 mm therebetween.

11. The retractable ladder according to claim 1, wherein the unlock pedal is disposed at the lowest ladder section at a height of about 10-20 cm above the ground.

* * * * *